United States Patent [19]

Jennings et al.

[11] 4,062,576

[45] Dec. 13, 1977

[54] SLIDING GLASS WINDOW AND DOOR LOCK

[76] Inventors: Robert Newton Jennings, 4026 Olympic St., San Diego, Calif. 92115; John Murray, 3165 Brilene Lane, San Diego, Calif. 92111; Donald Herbert Hartleben, 4494 Benhurst Ave., San Diego, Calif. 92122

[21] Appl. No.: 684,721

[22] Filed: May 10, 1976

[51] Int. Cl.[2] ..... E05C 19/18

[52] U.S. Cl. ..... 292/258; 292/DIG. 46; 292/257

[58] Field of Search ..... 292/DIG. 46, 257, 258, 292/288

[56] References Cited

U.S. PATENT DOCUMENTS

| | | | |
|---|---|---|---|
| 840,077 | 1/1907 | Moxwell | 292/257 |
| 2,095,037 | 10/1937 | Reintjes | 292/257 X |
| 2,629,466 | 2/1953 | Nardulli | 292/257 X |
| 3,756,641 | 9/1973 | Dugan | 292/258 |
| 3,975,041 | 8/1976 | Edison | 292/258 |

*Primary Examiner*—Richard E. Moore

*Attorney, Agent, or Firm*—Brown & Martin

[57] ABSTRACT

The device locks the sliding panel against horizontal and vertical movement. The device is secured on one of the upraised walls of the panel track by an eccentric that works in opposition to a support flange. The support flange carries slide stops to prevent the panel from sliding in its track. The vertical movement of the window out of the track is prevented by a lift stop comprising a flat spring secured in the upper track or lift stop elements on the support flange.

14 Claims, 7 Drawing Figures

SLIDING GLASS WINDOW AND DOOR LOCK

BACKGROUND OF THE INVENTION

Sliding glass windows and sliding glass doors have come into widespread use in home construction. Such doors and windows are distinguished from conventional construction in that they slide in horizontal tracks rather than being lifted vertically in vertical tracks or swinging on a vertical hinge axis. Sliding glass windows and doors are generally considered to be more adaptable to different installations than conventional fixtures, to provide a more attractive installation, and to be easier to use and maintain. However, the installational and operational flexibility of such windows and doors also results in an installation that is difficult to securely lock. The locking or latching devices provided as part of such sliding panels typically do not prevent an intruder from lifting the sliding panel into the upper track sufficiently to clear the lower track so that the panel may be lifted completely free of the tracks, or at least sufficiently to permit the intruder to move the panel so that a wire or hook may be inserted between the sliding and fixed panels and utilized to operate the latch.

An increase in the crimes against property including vandalism and burgulary has made it increasingly important to secure sliding panels against unauthorized operation. As a result of widespread acknowledgement of the need, numerous sliding glass door and sliding window supplemental locks have been provided. One such device is in the form of a dead bolt which is permanently mounted on the track and is operated in and out of holes drilled through the window track. Such devices are sufficiently difficult to operate and they frequently fall into disuse. The required installation discourages widespread use and permanently disfigures the window or door track. Other devices have been provided which are intended to be temporarily applied to the window or track to secure the window against horizontal movement. However, such devices have typically not provide a sufficiently strong purchase againt the track or window to prevent the sliding panel from being forced open.

Therefore, it is desirable to have a sliding glass window and door lock that does not require permanent installation and yet securely locks the sliding panel against vertical lifting and horizontal sliding.

SUMMARY OF THE INVENTION

An exemplary embodiment of the invention incorporates an eccentric that works in opposition to a support flange. The device is secured onto the side walls of the upper and lower track. The eccentric is operated to obtain a frictional engagement of the selected side wall between the eccentric and support flange. Slide stops protrude beyond the support flange and into the operating area of the track to prevent sliding movement of the sliding panel.

The device also incorporates lift stops to prevent the sliding panel from being lifted clear of the lower track. In a first embodiment of the invention, the lift stop comprises a flat spring which has a bias toward assuming a U-shaped configuration. The spring legs are spread so that the lift stop may be inserted into the upper track. Spring action then causes the leg members to contact the side walls of the track and to frictionally hold the lift stop in position. In a second embodiment, the lift stops are carried on the support flange so that when the device is secured onto the side wall of the upper track, the lift stop will automatically be positioned above the sliding panel and between the upper surface of the sliding panel and the horizontal surface of the upper track.

Thus, the invention provides a device that is rapidly secured to the tracks without tools and secures the sliding panel against unauthorized sliding movement. The eccentric action produces a locking engagement with the side walls of the track. Any attempt to slide the sliding panel open with the device in position is resisted by the frictional engagement between the eccentric and side wall. The engagement pressure between the eccentric and side wall increases in response to increase in the force utilized in an attempt to make the window open.

The lift stops incorporated in both embodiments of the invention are easily installed and removed without tools. However, they are effective in position to prevent unauthorized vertical movement of the window so that not only can an intruder not lift the sliding panel clear of the lower track, but insufficient vertical travel is produced to obtain any clearance between the sliding and fixed panels. Therefore, no device may be fitted between the panels to jimmy or operate the conventional lock or the instant device from the outside of the opening.

It is therefore an object of the invention to provide a new and improved sliding glass window and door lock.

It is another object of the invention to provide a new and improved sliding glass window and door lock that prevents an intruder from lifting the sliding panel clear of the lower track.

It is another object of the invention to provide a new and improved sliding glass window and door lock that may be easily installed and removed without tools.

It is another object of the invention to provide a new and improved sliding glass window and door lock that is rapidly operated in the event of an emergency.

It is another object of the invention to provide a new and improved sliding glass window and door lock that resists attempts to force the sliding panel against the operation of the lock.

It is another object of the invention to provide a new and improved sliding glass window and door lock that is inexpensive to manufacture.

It is another object of the invention to provide a new and improved sliding glass window and door lock that has a long service life.

Other objects and many attendant advantages of the invention will become more apparent upon a reading of the following detailed description together with the drawings in which like reference numerals refer to like parts throughout and in which:

DETAILED DESCRIPTION OF THE DRAWINGS

Figure 1:
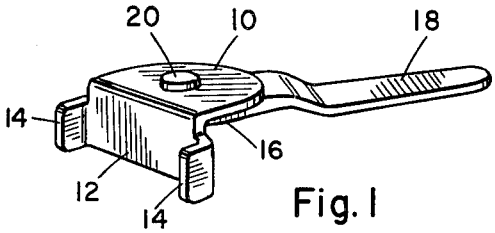
FIG. 1 is a perspective view of one embodiment of the lock unit.
Figure 2:
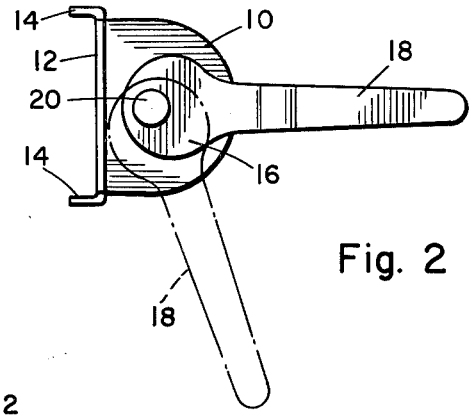
FIG. 2 is an underside view of the unit.

Referring particularly to the FIGS. 1 and 2, there is illustrated the window and door lock of the invention incorporating a base 10. The base is a generally horizontally arranged planar member and is connected to an orthogonally related support flange 12 along one edge of the base 10. A pivot pin 20 is received through the base 10 and carries an eccentric 16 in opposition to the support flange 12. An operating lever 18 is formed integrally with the eccentric 16 for rotating the eccentric between the open position and the closed or locked position, illustrated in full line and broken line, respectively, in FIG. 2. A pair of slide stops 14 extend from the opposite face of the support flange 12.

Figure 3:
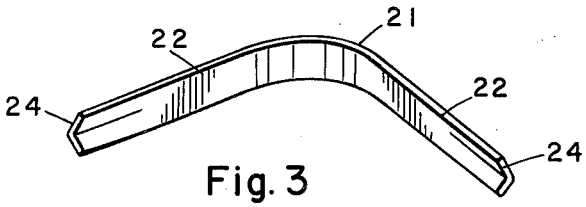
FIG. 3 is a perspective view of the lift stop.

The lift stop 21, shown in FIG. 3, is a separate element in the form of a generally flat spring 21 formed of spring steel with a bias toward assuming an U-shaped configuration. The legs 22 of the spring terminate in cupped engagement ends 24.

Figure 6:
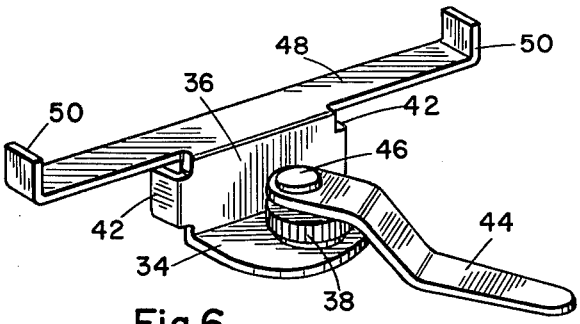
FIG. 6 is a perspective view of another embodiment of the lock unit.

Referring to FIG. 6, a second embodiment of the invention is illustrated. A base 34, support flange 36, and slide stops 42 generally correspond to the equivalent members on the first embodiment. However, a pair of lift stops 50 are integrally mounted on the device. An elongated lift stop mounting element 48 is secured to the top edge of the support flange 36 and is aligned with the orientation of the track so that the lift stops 50 are positioned above the sliding panel between the upper surface of the panel and the horizontal surface of the upper track. In the second embodiment, the eccentric incorporates a generally circular cam member 38 having a serrated engagement surface 40. The circular cam member 38 is mounted on a pivot pin 46 which is offset from the center of the circular cam. Operating lever 44 is secured as by welding to the circular cam member 38.

The engagement surfaces of the eccentric 16 and cam member 38 are made of material, such as hardened steel, which is harder than the material for the walls 30 and 32 of the tracks 26 and 28. Such a hardness relationship results in a dependable locking action and provides a long service life for the device.

Figure 4:
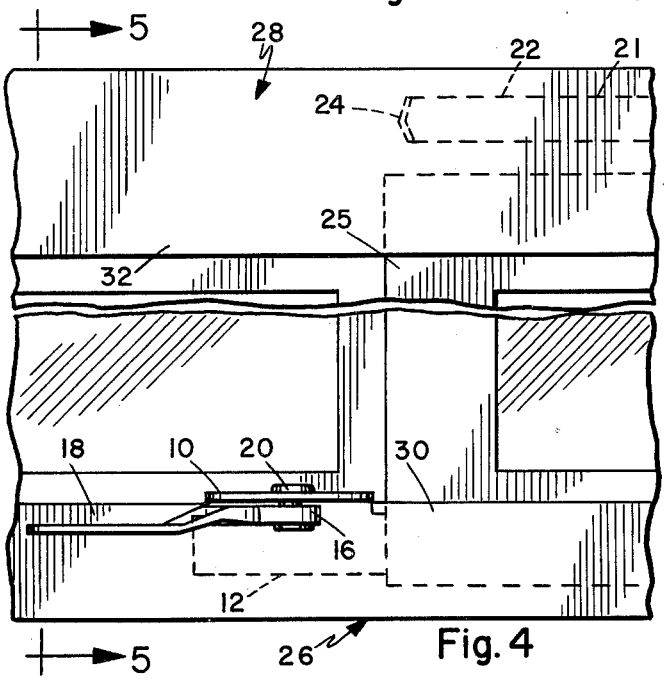
FIG. 4 is a side elevation view of a sliding panel and frame assembly, with the lock unit and lift stop installed.
Figure 5:
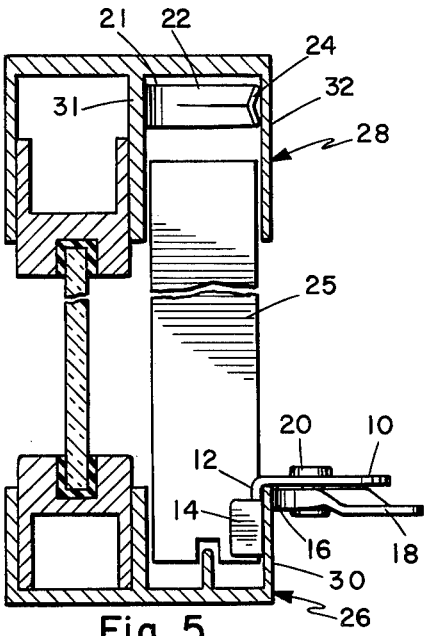
FIG. 5 is a sectional view taken on line 5—5 of FIG. 4.

The first embodiment is installed by moving the sliding panel 25 to its extreme open position. In the open position, the sliding panel exposes the upper track 28 so that the flat spring lift stop 21 may be installed. For installation, the spring 21 is grasped by the legs 22 and biased toward a relatively flat configuration. The spring is then inserted into the track 28 and released. Upon release, the bias on the spring 21 causes the legs 22 to move toward a U-shaped configuration, increasing the widthwise dimension of the spring and causing the base of the U-shaped member to contact a first wall 31 of the upper track and the cupped engagement ends 24 to contact the opposite side 32. The cupped shape of the ends 24 forces two relatively sharp portions of the cupped sections into engagement with the wall 32 and firmly hold the lift stop 21 in position, as in FIGS. 4 and 5. Thereafter, when the sliding panel 25 is returned to the closed position, the spring 21 will be interposed between the upper surface of the sliding panel 25 and the horizontal portion of the upper track 28. Accordingly, any attempt to lift the panel 25 will cause contact between the panel 25 and spring 21 and sharply limit the upward travel. Therefore, the panel 25 cannot be moved vertically sufficiently for it to clear the lower track.

The horizontal portion of the lock is installed on the lower track 26 by interposing the side wall 30 of the lower track between the eccentric 16 and support flange 12. Thereafter, the operation of the operating lever 18 from the open position in FIG. 3 to the locked position in FIG. 1 will cause a frictional engagement between the surface of the eccentric 16 and the side wall 30. Any attempt thereafter to slide the sliding panel 25 will cause the end of panel 25 to contact a slide stop 14. Since the eccentric 16 is in frictional engagement with fixed structure in the form of upraised wall 30, any relative movement caused by force applied to slide stop 14 will further rotate the eccentric 16 into greater engagement against the upraised wall 30. Thus, greater intruder applied force results in greater locking force. From the inside, the device is quickly removed by operating the lever 18 to the center position, thereby providing sufficient clearance between the eccentric 16 and support flange 12 such that the entire device may be slid clear or removed from the wall 30. The window may be removed from the track for cleaning or other service by sliding the window open beyond the point of installation for the lift stop 21.

Figure 7:
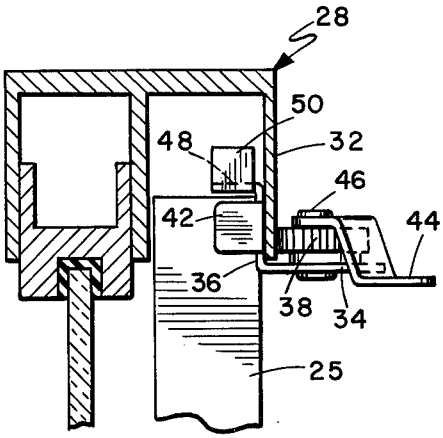
FIG. 7 is a sectional view similar to a portion of FIG. 5, showing the lock unit of FIG. 6 installed above a sliding panel.

The installation of the second embodiment, is similar to that of the first, excepting that the second embodiment is installed on the wall 32 of the upper track 28, as in FIG. 7. For installation, the mounting element 48 is angled upwardly so that the lift stop 50 passes over the top of the panel 25 and into the space between the top of the panel 25 and the horizontal surface of the track 28. The device is moved horizontally until the slide stop 42 engages the panel 25, then the device is moved vertically so that the wall 32 extends into the slot between the support flange 36 and cam 38. Thereafter, rotation of the cam 38 about the offset center 46 will cause the serrated surface of the cam to contact the wall 32. With the device in place, attempted operation of the panel 25 with the device into position will produce the corresponding additional engagement pressure between the cam 38 and wall 32. Any attempt to lift the panel 25 will cause the panel to engage the lift stop 50 and will thereby limit the vertical movement of the panel so that it may not be lifted clear of the lower track 26.

Having described our invention, we now claim:

1. In a device for securely locking a sliding panel against sliding movement along upper and lower parallel tracks and against vertical movement into the upper track and out of the lower track wherein the tracks have at least one sidewall and wherein the improvement comprises:

a base, a pivotally mounted eccentric on said base, an operating lever attached to said eccentric, an opposed support flange connected to said base opposite said eccentric, said eccentric and said support flange accommodating a side wall of a sliding panel track, a slide stop connected to said device and positioned to extend across the track and block the sliding panel against horizontal movement, lift stop means for preventing the sliding panel from being raised vertically in the track, positioned vertically above said base, and having the entire horizontal extent thereof positioned between the upper surface of the sliding panel and the upper track.

2. In a device for securely locking a sliding panel against sliding movement along upper and lower parallel tracks and against vertical movement into the upper track and out of the lower track, wherein the tracks have at least one sidewall and wherein the improvement comprises:

a base, a pivotally mounted eccentric on said base, an operating lever attached to said eccentric, an opposed support flange connected to said base opposite said eccentric, said eccentric and said support flange accommodating a side wall of a sliding panel track, a slide stop connected to said device and positioned to extend across the track, lift stop means for preventing the panels from being raised vertically in the track positioned between the upper surface of the sliding panel and the upper track, said lift stop means comprising two spaced lift stop elements secured to a lift stop mounting element, said lift stop mounting element comprising a flat elongated member aligned with said track and secured at the top of said support flange.

3. The device according to claim 2 wherein:

said base comprises a generally horizontal arranged planar section, said support flange is orthogonally related to said base and is secured along one edge thereof, said eccentric is pivotally mounted on a vertical axis for movement of said eccentric toward and away from said support flange.

4. The device for securing locking a sliding panel according to claim 3 wherein:

said slide stop comprises at least one stop flange orthogonally related to and secured to said support flange.

5. A device for securing locking a sliding panel according to claim 2 wherein:

said eccentric comprises a generally circular cam member mounted by an offset pivot pin to said base.

6. A device for securely locking a sliding panel according to claim 2 wherein:

said eccentric comprises a cam member having a serrated engagement surface.

7. A device for securely locking a sliding panel according to claim 2 wherein:

said eccentric comprises a member having an engagement surface that is harder than the side wall of said track.

8. A device for securely locking a panel according to claim 1 wherein:

said base comprises a generally horizontally arranged planar section, said support flange is orthogonally related to said base and is secured along one edge thereof, said eccentric is pivotally mounted on a vertical axis for movement of said eccentric toward and away from said support flange.

9. A device for securely locking a sliding panel according to claim 8 wherein:

said slide stop comprises at least one stop flange orthogonally related to and secured to said support flange.

10. A device for securely locking a sliding panel according to claim 1 wherein:

said eccentric comprises a generally circular cam member mounted by an offset pivot pin to said base.

11. A device for securely locking a sliding panel according to claim 1 wherein:

said eccentric comprises a cam member having a serrated engagement surface.

12. A device for securely locking a sliding panel according to claim 1 wherein:

said eccentric comprises a member having an engagement surface that is harder than the side wall of said track.

13. A device for securely locking a sliding panel according to claim 1 wherein:

said lift stop means comprises a flat spring having a bias toward assuming a U-shaped configuration.

14. A device for securely locking a sliding panel according to claim 13 wherein:

the terminal portions of said spring form cupped engagement ends.

* * * * *